United States Patent [19]

Trenkle et al.

[11] Patent Number: 4,854,488

[45] Date of Patent: Aug. 8, 1989

[54] SHROUD TUBE SUPPORT AND CHANGING DEVICE

[75] Inventors: Charles Trenkle; James B. Sears, Jr., both of Riverview, Mich.

[73] Assignees: National Steel Corporation, Pittsburgh, Pa.; Gladwin Corporation, Taylor, Mich.

[21] Appl. No.: 165,283

[22] Filed: Mar. 8, 1988

[51] Int. Cl.[4] ..... B22D 37/00

[52] U.S. Cl. ..... 222/607; 164/337; 266/236

[58] Field of Search ..... 222/595, 596, 599, 600, 222/601, 606, 607; 266/236, 287; 164/337

[56] References Cited

U.S. PATENT DOCUMENTS

| | | | |
|---|---|---|---|
| 3,460,725 | 8/1969 | Golde et al. | 222/607 |
| 4,316,561 | 2/1982 | Grosko | 222/607 |
| 4,415,103 | 11/1983 | Shapland et al. | 222/603 |
| 4,550,867 | 11/1985 | Bell et al. | 222/607 |
| 4,593,838 | 6/1986 | Oberbach et al. | 222/607 |
| 4,625,787 | 12/1986 | Haveman et al. | 164/453 |
| 4,658,994 | 4/1987 | Fricker | 222/607 |

FOREIGN PATENT DOCUMENTS

| | | | |
|---|---|---|---|
| 2851480 | 5/1979 | Fed. Rep. of Germany | 164/337 |
| 17431 | 5/1971 | Japan | 164/337 |
| 124018 | 8/1979 | Japan | 222/607 |
| 3655 | 1/1986 | Japan | 222/607 |
| 2171348 | 8/1986 | United Kingdom | 222/607 |

OTHER PUBLICATIONS

*Iron and Steel Metallurgy,* May, 1987, p. 30.

*Primary Examiner*—Robert Mc Dowell
*Attorney, Agent, or Firm*—O'Neil and Bean

[57] ABSTRACT

An improved shroud tube supporting and changing apparatus for use in a bottom pour metal teeming operation includes an elongated arm having its midpoint mounted on the teeming vessel for free rotation about a generally vertical axis and for limited pivotal movement about a horizontal axis, and a shroud tube support on each end of the elongated arm for engaging and providing gimbal-like support for a shroud tube. A power actuator mounted on the teeming vessel is selectively operable to pivot the arm about the horizontal axis in one direction to maintain a fluid tight seal between the shroud tube and the bottom pour opening in the teeming vessel, and to permit the arm to be pivoted in the other direction to disengage the shroud tube from the bottom pour opening and permit the arm to be rotated about the vertical axis to place a new shroud tube in position beneath the bottom pour opening.

15 Claims, 3 Drawing Sheets

SHROUD TUBE SUPPORT AND CHANGING DEVICE

BACKGROUND OF THE INVENTION

1. Field of the Invention

This invention relates to apparatus for use in pouring molten metal from a teeming vessel through a shroud tube into a receiving vessel such as the mold of a continuous caster, and more particularly to an improved apparatus for changing the shroud tube used in such apparatus and for supporting the shroud tube in a manner to maintain a more positive seal with the nozzle or tube holder of a sliding gate throttling valve used on a teeming vessel.

2. Description of the Prior Art

In the pouring of molten metal from a bottom pour teeming vessel such as a tundish used in the continuous casting of steel, it is conventional practice to control the flow of the liquid metal from the tundish by use of a sliding gate throttling valve. Metal from the throttling valve flows through a pouring tube, or shroud tube, constructed of a high temperature resistant ceramic or other material and having one or more outlets submerged in the liquid metal contained in a receiving vessel such as the continuous caster mold. A throttling valve and shroud tube assembly of the type commonly used in the continuous casting of steel is illustrated and described in U.S. Pat. No. 4,415,103, the disclosure of which is incorporated herein by reference and this invention will be described with reference to the teeming of molten steel from a tundish through a valve of this general type in a continuous casting operation, it being understood that the invention may be used in conjunction with other valve mechanisms and in other metal teeming operations.

In the continuous casting of steel using a throttling valve and shroud tube, it is critical that a good seal be maintained between the shroud tube and the throttling valve to avoid exposure of the molten metal stream to the atmosphere as it passes through the assembly. The aspiration effect of the flowing steel stream can readily draw sufficient air through eve a relatively small opening to cause substantial increase in the oxygen content of the steel so that it may be necessary to downgrade the cast product and sell it at a reduced price.

The high temperatures to which the shroud tube is subjected in a continuous steel casting operation, combined with the errosive effect of the molten steel flowing through the shroud tube and the stresses and errosive effects produced by the continuous movement of the caster mold into which the lower end of the shroud tube projects makes it necessary to frequently change the shroud tube. Shroud tubes formed from ceramic material of the type commonly used may have a life expectancy of from $\frac{1}{4}$ to $\frac{1}{2}$ that of the mating tube holder assembly in the throttle valve. Nevertheless, in view of the criticality of maintaining a good seal between the two parts and to minimize the time during which the metal flow is interrupted during changing of a shroud tube, it is conventional practice to preassemble a new shroud tube and tube holder which assembly is then installed as a unit. While this practice makes it possible to remove and replace a spent shroud tube relatively quickly, it requires substantial time in assembling the shroud tube and tube holder in a manner to provide the necessary airtight seal and requires a substantial sacrifice in ceramics by discarding a tube holder, which otherwise might have substantial useful life remaining, each time a shroud tube is changed.

Numerous devices have been developed for handling and manipulating shroud tubes of the type employed to enclose a stream of molten metal flowing from the bottom pour discharge nozzle of a ladle into a casting tundish. In such an operation full ladles are positioned above the tundish, emptied and removed in succession, making it necessary to change the shroud tube upon each ladle change. In such operation, positioning the shroud tube normally requires careful alignment and manipulation, after which the shroud tube may be releasably secured to the support structure of the valve as disclosed, for example, in U.S. Pat. No. 4,316,561.

Shroud tube positioning and manipulating apparatus for use in connection with a teeming ladle is also known which continuously supports the tube and retains it in position in contact with the outlet nozzle during teeming. Such devices are normally supported by rigid structure independent of the ladle, making it necessary to support the shroud tube with a biasing force which permits limited vertical and horizontal movement with corresponding movement of the heavy ladle during the teeming operation. One such device is disclosed, for example, in U.S. Pat. No. 4,550,867 which employs a fluid cylinder in connection with an articulated arm supported on a rigid frame structure for maintaining a continuous biasing force between the shroud tube and gate valve while permitting movement of the shroud tube with the ladle. The use of a counterbalancing weight is also known for applying a biasing force in such shroud tube support.

The use of a counterweight to apply a biasing force to a shroud tube used in connection with a casting tundish throttle valve is also known and employed in a commercial slide gate throttling valve manufactured by Interstop Corp. as shown in *Iron and Steel Metallurgy,* May 1987, pg. 30. In this construction, a horizontal track arrangement mounted on the flow control valve supports rollers adjacent a yoke on one end of an elongated arm for supporting a shroud tube, and an outwardly projecting eyelet on the opposite end of the arm for supporting a counterweight. Such arrangements, however, are inherently difficult to manipulate in that the counterweight must be lifted and moved with the arm upon retracting the apparatus, and removal of the hot spent shroud tube and installation of a second tube is inconvenient and time consuming. Further, as erosion of the shroud tube takes place counterbalancing force from the fixed counterweight will vary.

In order to overcome the disadvantages of the prior art, it is a primary object of the present invention to provide an improved shroud tube supporting and changing apparatus for use in the bottom pour teeming of molten metal.

Another object is to provide such a improved apparatus which enables very rapid changing of the shroud tube and which provides a more positive air seal between the shroud tube and throttling valve.

Another object is to provide such an apparatus which is mounted directly on and supported by the teeming vessel and which is operable to accurately, easily and reliably position a shroud tube relative to the throttling valve.

SUMMARY OF THE INVENTION

The foregoing and other disadvantages of the prior art throttling valve and shroud tube assemblies are overcome in accordance with the present invention which enables the rapid changing of the shroud tube alone an holding the shroud tube in contact with the refractories of the tube holder of the throttle valve assembly in a manner to provide a more positive seal without requiring mechanical assembly of the tube and tube holder. This is accomplished by providing a shroud tube carousel assembly adapted to be mounted directly onto a tundish vessel in fixed relation to the throttling valve assembly for manipulating a shroud tube during installation and for retaining the shroud tube in position in contact with the tube holder refractory during use. The shroud tube carousel includes an elongated arm and pivot means supporting the arm on the teeming vessel for free pivotal movement in a generally horizontal plane about a fixed substantially vertical axis.

A shroud tube yoke is carried on each end of the elongated ar mounted on the tundish vessel in position to receive and support a shroud tube. The yoke provides a gimbal-like universal support enabling the shroud tube to assume its normal vertical attitude while permitting limited free movement as necessary to provide a uniform, tight surface-to-surface seal between the top and surface of the shroud tube and the downwardly directed surface of the tube holder of a sliding gate throttle valve mounted on the bottom wall of the tundish. The pivot means also permits limited pivotal movement of the elongated arm about a horizontal axis perpendicular to and intersecting the fixed vertical axis to raise or lower a shroud tube supported in a yoke on the end of the arm. The yokes are supported for easy removal from the arm whereby a spent shroud tube may be removed with its supporting yoke to expedite shroud tube change.

A two-way fluid actuated linear motor, or ram, is mounted on the tundish at a position outboard of the elongated arm pivot mean in position to engage the elongated arm to pivot it about its horizontal pivot axis to raise a shroud tube into sealing engagement with a tube holder when the vertical axis of the shroud tube and tube holder are in alignment. Fluid pressure to the ram provides a positive sealing force while the gimbal support of the yoke enables uniform sealing pressure to be applied around the entire periphery of the shroud tube top surface. The fluid ram ma include spring means providing a predetermined sealing pressure in the event of loss of fluid pressure during operation, with the fluid pressure operating in the opposite direction on the double acting cylinder being sufficient to overcome the spring pressure when it is desired to break the seal as for changing a shroud tube. When a shroud tube supported on one end of the elongated arm is held in sealing, operable relation with the tube holder of the throttle valve, the opposite end of the elongated arm projects outwardly from the tundish in position to be freely accessible. In this position, a second shroud tube may be manually placed in the yoke on the outwardly extending end and retained in a standby position for the next shroud tube change.

When it is desired to change a shroud tube, the slide gate of the throttle valve is actuated to stop the flow of molten metal from the tundish, and the fluid ram is actuated in a direction to overcome the spring pressure and pivot the elongated arm in a direction to lower the spent shroud tube from engagement with the tube holder. Before commencing the tube change, the tundish is raised so that the bottom of the spent shroud tube is spaced above the top of the mold, and when the arm is lowered the spent tube can be readily pushed with its supporting yoke from the inwardly projecting end of the elongated arm. Thereafter, the elongated arm is freely pivotable about the pivot means to bring the standby shroud tube into axial alignment with the tube holder and the fluid ram reversed to quickly and accurately position the standby shroud tube in an operable position. The tundish may then be lowered to project the end of the shroud tube into the molten metal in the caster mold and the throttle valve slide gate opened to continue the casting operation. At a convenient time, the spent shroud tube and its supporting yoke can be retrieved and the yoke replaced on the arm in position to receive another standby shroud tube.

BRIEF DESCRIPTION OF THE DRAWINGS

Other features and advantages of the invention will be apparent from the detailed description contained hereinbelow, taken in conjunction with the drawings, in which.

DESCRIPTION OF THE PREFERRED EMBODIMENT

Figure 1:
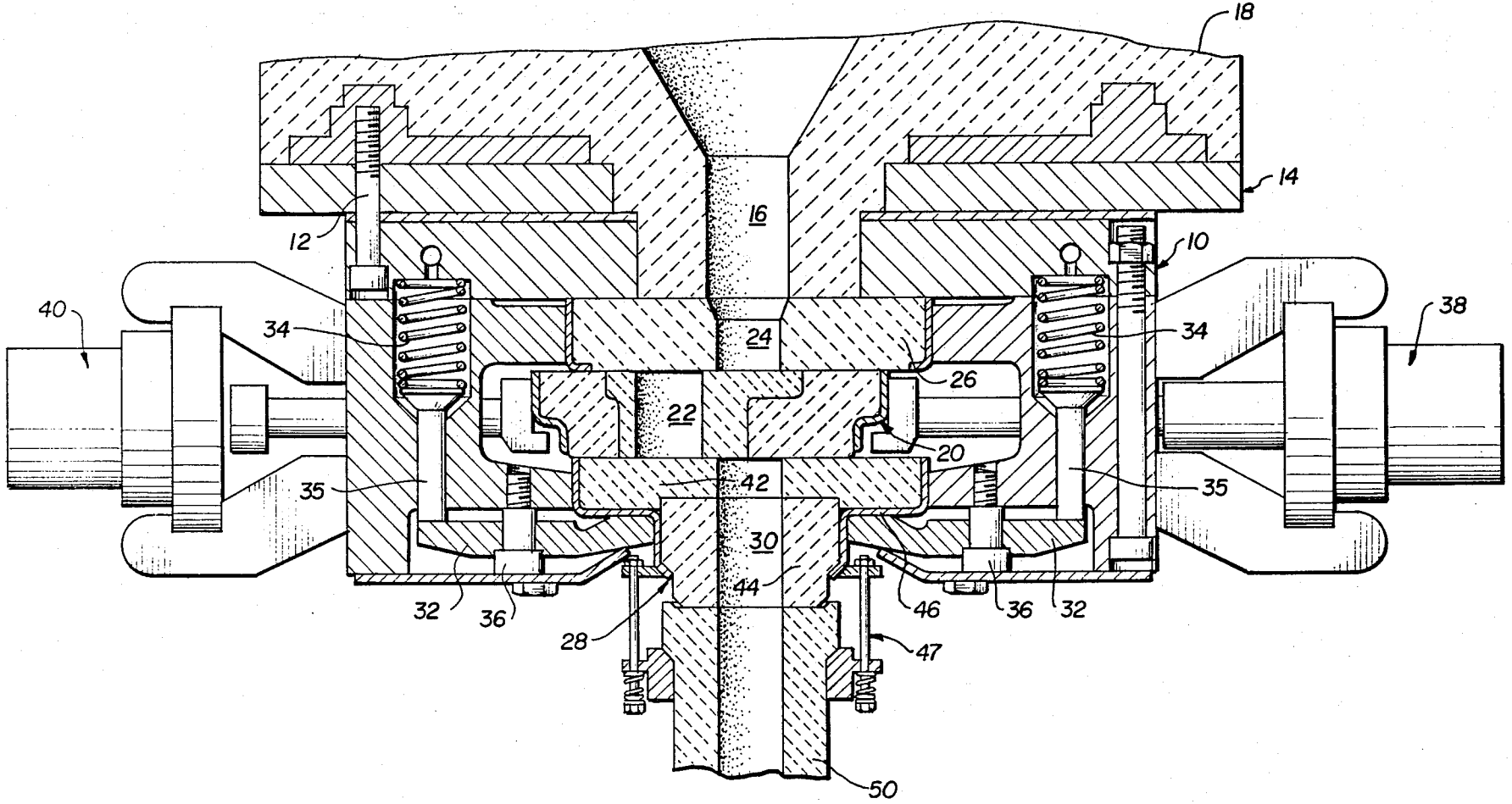
FIG. 1 PRIOR ART
FIG. 1 is a fragmentary sectional view of a known slide gate-type throttle valve and shroud tube mounted on the bottom of a tundish.

FIG. 1 shows a sliding gate throttle valve mechanism designated generally by the reference numeral 10 adapted to be rigidly mounted, as by bolts 12 onto the bottom steel wall 14 of a teeming vessel such as a tundish used for teeming molten metal into the mold of a continuous caster, not shown. Bolts 12 rigidly mount the throttling valve 10 in operative alignment with a pour opening 16 in the refractory lining 18 of the tundish, and teeming of molten metal through opening 16 is controlled by manipulation of a sliding refractory plate gate assembly 20 to position a through opening 22 in assembly 20 relative to the pour opening 16 in the tundish and an axially aligned opening 24 in a fixed refractory plate 26 supported in sealing relation with respect to the refractory lining 18 of the tundish. A tube holder assembly 28 having a central opening 30 therein in axial alignment with openings 16 and 24 is supported beneath the sliding gate 20 and has its top surface urged into sealing relation with the bottom surface of gate 20 by a plurality of rocker arms 32 biased by springs 34 and plungers 35 for pivotal movement about mounting bolts 36 to provide a tight seal between contacting surfaces of the top fixed refractory plate 26, the sliding gate 20, and the tube holder 28. Gate 20 may be controlled in its movement by fluid actuator assemblies indicated generally at 38 and 40 in a manner described, for example, in U.S. Pat. No. 4,625,787. Other means of controlling the position of sliding gate member 20 to control and regulate the flow of molten metal through the assembly are also known. The teeming vessel and throttle valve assembly thus far described is a conventional, commercially available assembly, the major components and operation of which are disclosed in the above-mentioned U.S. Pat. No. 4,415,103.

In the valve of FIG. 1, the tube holder assembly 28 comprises an upper refractory plate 42 and a lower refractory spool member 44 retained in assembled relation by a shaped metal housing 46 with the housing member being engaged by the rocker arms 32 to urge the assembly upward into sealing relation with the sliding gate 20. In an alternate, commercial embodiment, plate 42 may consist of a rigid, generally rectangular metal plate having an enlarged central opening lined with a refractory material to define the portion of opening 30 extending therethrough, with the spool 44 being retained on the plate in the same manner illustrated in FIG. 1. In each known embodiment, a spring and bolt assembly 47 extending between housing 46 and a collar 48 engaging shroud tube 50 retains the shroud tube and tube holder in assembled relation for insertion or removal as a unit.

Referring now to FIGS. 2–6, the improved shroud tube supporting and handling mechanism of the present invention will be described. In the embodiment illustrated an elongated arm 52 is supported at its midpoint for limited pivotal movement in a vertical plane by a pin 54 extending horizontally through the arm 52 and a pair of plate members 56 extending one along each side of the arm. Plates 56 are rigidly welded to a transverse support plate 58 which, in turn, is mounted for free rotation in a horizontal plane by a vertical support pin 60 extending into and supported by a thrust bearing assembly 62 rigidly mounted, as by bolts not shown onto the rigid frame of throttle valve 10.

A double acting fluid ram assembly 68 is mounted on the tundish shell 14 at a location outboard of the thrust bearing assembly 62 with its longitudinal axis extending in a common vertical plane with the vertical axes of pin 60 and opening 30 in tube holder 28. A rigid bracket 70 of ram assembly 68 is mounted, as by bolts not shown directly to the tundish shell 14, with the ram extending vertically downward therefrom. Fluid under pressure is supplied through line 74 to the piston end of cylinder 78 to project the rod 76 from cylinder 78. An enlarged bearing head 77 is carried on the projecting end of rod 76 to engage the outwardly projecting end of arm 52 as most clearly seen in FIG. 2. Fluid under pressure is applied through line 80 to the rod end of cylinder 78 to retract rod 76 when it is desired to lower shroud tube 50 from engagement with the refractory spool 44 of tube holder 28. To prevent inadvertent lowering of the shroud tube 50 during teeming, ram assembly 68 also includes a coil spring 82 surrounding the outwardly projecting end of rod 76 with one end of the spring bearing on the end of a protective sleeve 79 surrounding cylinder 78 and its other end bearing on the plate 84 rigidly mounted on bearing head 77. A safety sleeve 85 mounted on plate 84 extends upwardly and surrounds coil spring 82 throughout a major portion of its length. As is apparent from FIG. 2, in order to retract the rod 76, fluid pressure supplied through line 80 must overcome the force of spring 82 whereas fluid pressure applied to line 74 acts with the force of the spring to positively retain the shroud tube 100 in sealing engagement with tube support spool 44 during the teeming operation.

Figure 2:
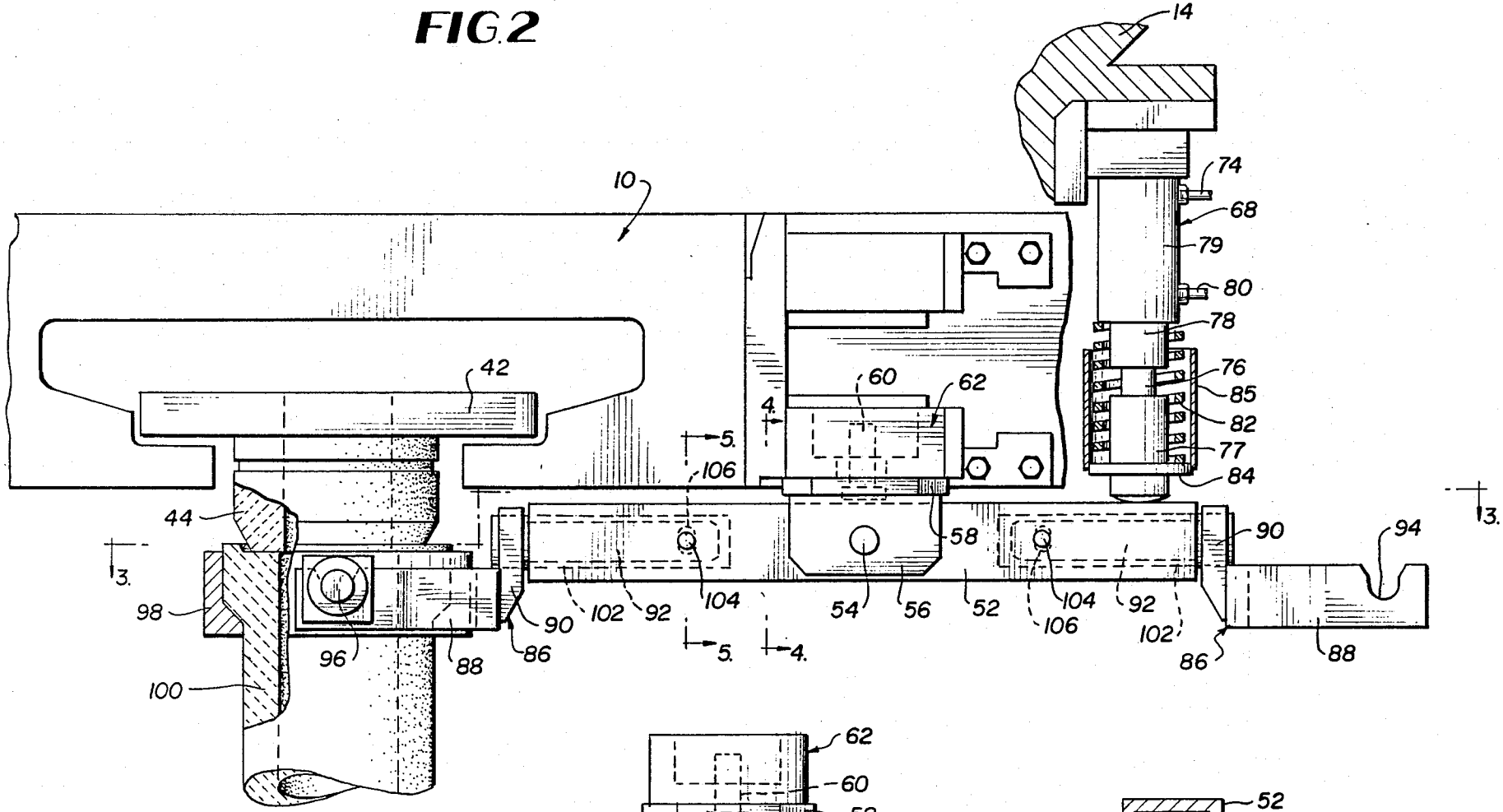
FIG. 2 is an elevation view of a shroud tube changing and supporting device of the present invention employed with a throttle valve of the type shown in FIG. 1 with portions broken away to more clearly illustrate other parts.
Figure 5:
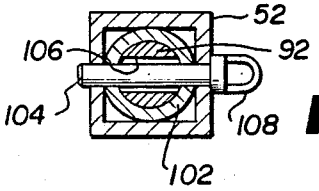
FIG. 5 is a sectional view taken on line 5—5 of FIG. 2.
Figure 4:
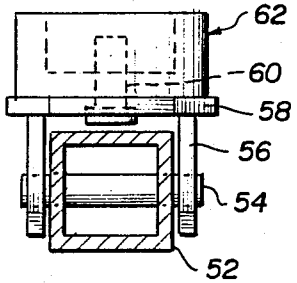
FIG. 4 is a sectional view taken on line 4—4 of FIG. 2.
Figure 3:
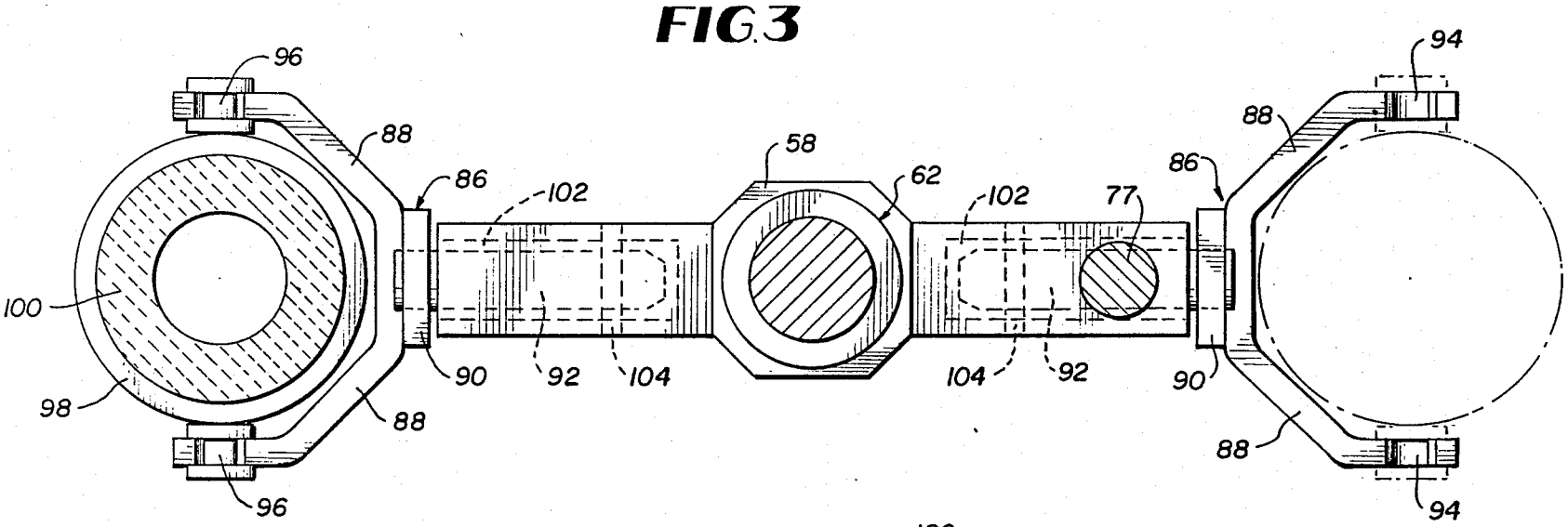
FIG. 3 is a view taken along lines 3—3 of FIG. 2.

A pair of bifurcated support yokes 86 are mounted one on each end of the elongated arm 52 as shown in FIGS. 2 and 3. Yokes 86 and their mounting system are identical and accordingly only one will be described in detail, it being understood that the description applies equally to each yoke. Thus, the yokes 86 each comprise a generally U-shaped bracket member 88 having its central portion joined, through a rigid gusset 90 to a horizontally extending cylindrical shaft 92 and its free ends disposed in laterally spaced relation to one another. Each end portion arm member 88 has an upwardly directed generally U-shaped notch or journal 94 for receiving and supporting one of a pair of trunions 96 projecting outwardly on diametrically opposed sides of a trunion ring 98 attached to and supporting the upwardly directed enlarged end of a shroud tube 100. As shown in FIG. 5, elongated arm 52 is a hollow generally rectangular member and has a tubular bearing element 102 received in and rigidly welded to each end portion, with the inside diameter of element 102 being dimensioned to telescopingly receive the shaft 92 and permit limited free rotation of the shaft 92 about its longitudinal axis when received within the sleeve. Rotation of shaft 92 is limited by an elongated removable pin member 104 extending through arm 52 and an opening 106 in shaft 92 which is dimensioned to permit the desired limited rotation of the shaft about its longitudinal axis while substantially fixing the axial position of the shaft 92 within the sleeve 102. Preferably an eye 108 is provided on the end of pin 104 to permit its easy removal for reasons pointed out more fully hereinbelow.

Figure 6:
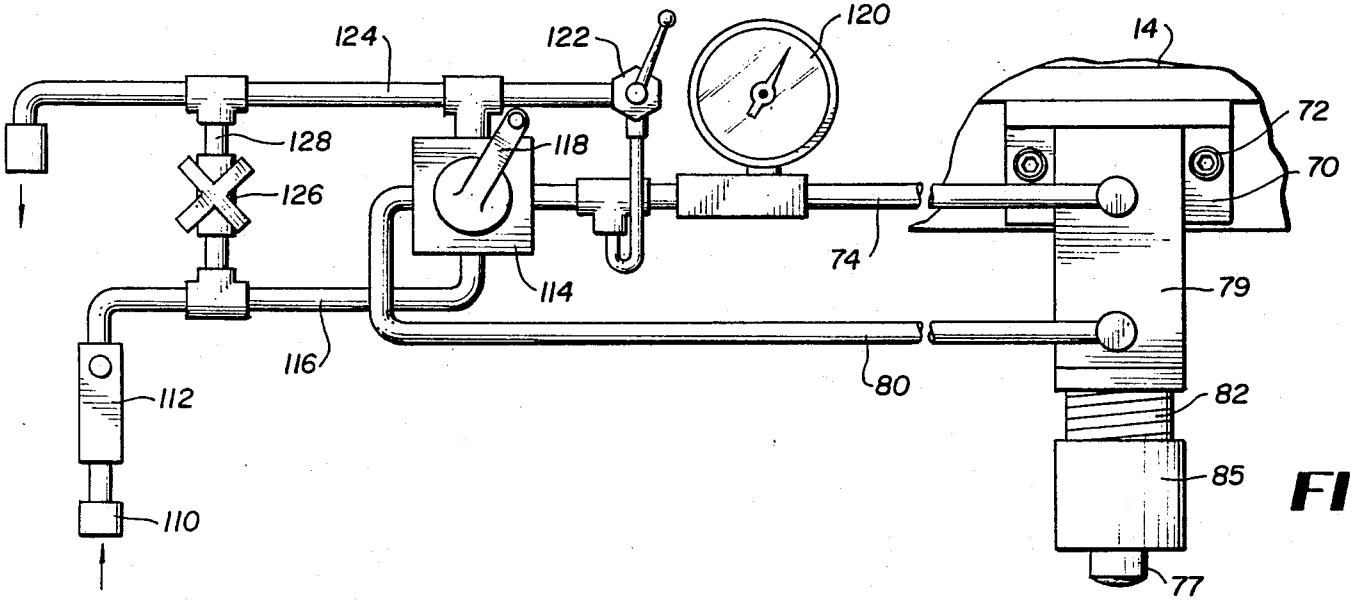
FIG. 6 is a schematic view of the fluid actuating mechanism for controlling operation of the shroud tube holder shown in FIGS. 2–5.

The fluid ram 68 preferably is a hydraulic oil ram, and a suitable control system for supplying fluid to the piston and rod end of cylinder 78 is illustrated schematically in FIG. 6. In this system, a quick disconnect hose coupling 110 is provided for receiving a high pressure hose to supply fluid through a flow regulator 112 and inlet line 114 to a three position, four way control valve 116. Valve 116 includes a manually actuated control lever 118 which is normally moved between a shroud tube up position, a valve closed position, and a shroud tube down position. In the full line tube up position shown, pressure fluid is supplied through line 74 to act on the piston in cylinder 78 and the rod end is vented through line 80 to project the rod 76 down and bring the enlarge bearing element 77 into contact with the top surface of arm 52. In this position, the fluid pressure acts in combination with the spring pressure to provide a sealing force between the top surface of shroud tube 100 and the bottom surface of spool element 44. In the left-hand or down position pressure is directed through line 80 and bled from line 74 so that the ram acts against the compressive force of spring 82 to raise the bearing element 77 whereby the weight of the shroud tube 100 disposed beneath the spool 44 tends to rotate the arm counterclockwise as seen in FIG. 2. Before raising the piston 76, a second shroud tube will normally be supported in the second or standby yoke assembly so that the complete arm and the two shroud tubes are substantially balanced about pin 74.

A pressure gauge 120 is provided in line 74 and an adjustable pressure relief valve 122 is connected between line 74 and an exhaust line 124 connected to a bypass port in valve 118. A normally closed manually operable needle valve 126 is connected in a line 128 extending between inlet line 116 and exhaust line 124 to permit manual bleeding of pressure oil from the system upon disconnecting the pressure inlet supply hose.

In operation of the system described above, when it is desired to change a shroud tube without changing the shroud tube holder, a new shroud tube is manually lifted and placed on the outwardly projecting yoke 86 with the trunion pins 96 resting in the upwardly directed slots 94. The pin 104 is inserted through the opening in the arm 82 and the shaft 92 to position the yoke axially with respect to the ar while permitting limited free rotational movement of the shaft 92 about the horizontal axis of arm 52. The limited free movement of the shroud tube 100 about the trunion axis provides, in effect, a universal or gimbal support for the tube.

The sliding gate refractory member 22 is then moved to the closed position and the tundish is raised to its fully up position to lift the used hot shroud tube from the molten metal in the caster mold. Control valve handle 118 is then moved to the "down" (lefthand) position so that the used and new shroud tubes are supported on opposite ends of arms 52 in a substantially balanced position around pin 54. By lifting on the outwardly projecting end of arm 52, or the new shroud tube, the used, hot shroud tube will be lowered from the spool 44 so that a pusher rod may then be manually used to push the used shroud tube and yoke assembly from the end of arm 52.

Once the used shroud tube is removed, the arm assembly and new shroud tube may be easily rotated about the vertical axis of thrust bearing 62 to bring the new shroud tube into position beneath the tube holder spool 44. Valve lever 118 is then shifted to the "up" position to pivot ar 52 about pin 54 and raise the new shroud tube into sealing contact with the bottom surface of spool 44. The positive pressure of the fluid cylinder, in combination with the universal support provided by the yoke, assures a positive seal between the new shroud tube and the throttle valve assembly. The tundish may then be lowered and the throttle valve reopened to continue teeming molten metal through the throttle valve and new shroud tube into the caster mold. Once the new shroud tube is installed and in position a hook is engaged in eye 108 of pin 104 to extract the pin which may then be used to accurately position the next shroud tube to be changed by the assembly. Control valve lever 218 is maintained in the "up" position, maintaining pressure fluid to the piston end of cylinder 78 during the teeming operation.

When it is deemed necessary to change the tube holder, the above procedure is followed except that, when the spent shroud tube is removed, a new shroud tube holder is inserted in the throttle valve block and installed in the usual manner as described in the above-mentioned U.S. Pat. No. 4,415,103. Once the tube holder is installed, the shroud tube changing procedure is continued to complete installation of the new shroud tube in the manner described above.

A new shroud tube may be installed using the present invention in substantially less time than by use of the commercial system employed in throttle valve assemblies of the type disclosed, for example, in the above-mentioned U.S. Pat. No. 4,415,103. Further, the positive seal between the shroud tube and shroud tube holder achieved with the universal support means and positive pressure of the present invention eliminates the necessity for changing the shroud tube holder each time a new shroud tube is inserted, thereby providing substantial savings both in the cost of the shroud tube holders and in the labor required for preassembling the shroud tube holders and shroud tubes in accordance with the prior practice.

The more positive seal achieved by the present invention also greatly reduced the chances of exposing the molten metal to atmospheric air which can rapidly reoxidize killed steel and thereby reduce the quality of the finished product.

While a preferred embodiment of the invention has been disclosed and described it should be understood that the invention is not so limited and that it is intended to include all embodiments of the invention which would be apparent to one skilled in the art and which come within the spirit and scope of the invention.

We claim:

1. An apparatus for use in a metal teeming operation in which molten metal is teemed through a throttle valve and shroud tube from a bottom opening in a teeming vessel into a receiving vessel positioned beneath the bottom opening, the throttle valve having a downwardly directed sealing surface and the shroud tube having an open top end terminating in an upwardly directed sealing surface for engaging and forming a seal with the downwardly directed sealing surface on the throttle valve, a shroud tube supporting and changing apparatus comprising:

coupling means mounted on the teeming vessel in laterally spaced relation to said bottom opening, an elongated arm mounted on an supported by said coupling means, said coupling means including pivot means engaging and supporting said elongated arm at its midpoint for limited pivotal movement about a first generally horizontal axis and for free rotation about a generally vertical axis, a pair of universal shroud tube supports mounted one on each end of said arm for movement therewith, said shroud tube supports each including means engaging and supporting a shroud tube adjacent its open top end and permitting limited free pivotal movement of the shroud tube about an axis parallel to said elongated arm and about a second generally horizontal axis extending generally perpendicular to said longitudinal arm whereby a shroud tube supported on one of said shroud tube supports may be rotated with said arm about said generally vertical axis to position the shroud tube beneath and in alignment with the bottom opening in the teeming vessel and pivoted with said elongated arm about said generally horizontal axis to engage the upwardly directed sealing surface on the shroud tube with the downwardly directed sealing surface on the throttle valve, and power means mounted on said teeming vessel, said power means including means operable to engage said elongated arm to pivot said arm and a shroud tube supported thereon about said first horizontal axis in a direction to urge the sealing surfaces on the throttle valve and the shroud tube into sealing relation with one another when the shroud tube is positioned in axial alignment with the bottom opening in the teeming vessel, said universal shroud tube support permitting pivotal movement of the shroud tube to assure accurate sealing engagement between said upwardly directed and said downwardly directed sealing surfaces.

2. The apparatus defined in claim 1 wherein said power means comprises a linear double acting fluid ram mounted on the teeming vessel in position to engage and pivot said elongated arm about said pivot means to urge the sealing surfaces on the throttle valve and shroud tube into sealing engagement.

3. The apparatus defined in claim 2 wherein said fluid ram is mounted on the teeming vessel at a location outboard of said coupling means with said fluid ram having its longitudinal axis located in a vertical plane containing the axis of the bottom opening and the vertical axis of rotation of the longitudinal arm.

4. The apparatus defined in claim 2 wherein said fluid ram further comprises resilient spring means normally urging said fluid ram in a direction to increase the sealing force between the sealing surfaces on the throttle valve and shroud tube.

5. The apparatus defined in claim 1 wherein said shroud tube supports each comprises a ring member mounted on a shroud tube adjacent its open top end, said ring member having a pair of trunions projecting outwardly therefrom, and yoke means having a pair of journals thereon, said journals being dimensioned and positioned to receive said trunions and support the shroud tube for limited free pivotal movement about a generally horizontal axis through said trunions and extending transversely of the longitudinal axis of the elongated arm.

6. The apparatus defined in claim 5 wherein said shroud tube support means further comprises means on each end of said elongated arm for releasably supporting one of said yokes for limited pivotal movement about an axis parallel to the longitudinal axis of said elongated arm.

7. The apparatus defined in claim 6 wherein said means for releasably supporting said yokes comprises an axially extending open ended sleeve on each end portion of said elongated arm, and each said yoke comprises an elongated shaft dimensioned to be telescopingly received in said sleeves.

8. The apparatus defined in claim 7 further comprising releasable retainer means operably associated with said elongated arm for engaging said yokes when said elongated shafts are received in said sleeves for axially positioning said yoke on said arm and for retaining said shaft means against withdrawal from said sleeve.

9. The apparatus defined in claim 8 wherein said releasable retainer means includes mean limiting pivotable movement of said yokes about the longitudinal axes of said elongated arm.

10. The apparatus defined in claim 6 wherein said power means comprises a linear double acting fluid ram mounted on the teeming vessel in position to engage and pivot said elongated arm about said pivot means to urge the sealing surfaces on the throttle valve and shroud tube into sealing engagement.

11. The apparatus defined in claim 10 wherein said fluid ram is mounted on the teeming vessel at a location outboard of said coupling means with said fluid ram having its longitudinal axis located in a vertical plane containing the axis of the bottom opening and the vertical axis of rotation of the longitudinal arm.

12. The apparatus defined in claim 11 wherein said fluid ram further comprises resilient spring means normally urging said fluid ram in a direction to increase the sealing force between the sealing surfaces on the throttle valve and shroud tube.

13. The apparatus defined in claim 12 wherein said means for releasably supporting said yokes comprises an axially extending open ended sleeve on each end portion of said elongated arm, and each said yoke comprises an elongated shaft dimensioned to be telescopingly received in said sleeves.

14. The apparatus defined in claim 8 further comprising releasable retainer means operably associated with said elongated arm for engaging said yokes when said elongated shafts are received in said sleeves for axially positioning said yoke on said arm and for retaining said shaft means against withdrawal from said sleeve.

15. The apparatus defined in claim 14 wherein said releasable retainer means includes means limiting pivotable movement of said yokes about the longitudinal axes of said elongated arm.

* * * * *